United States Patent [19]

Schutte

[11] 3,968,283

[45] July 6, 1976

[54] FLOCKED FILAMENTARY ELEMENT AND STRUCTURES MADE THEREFROM

[75] Inventor: Richard W. Schutte, Newtown Square, Pa.

[73] Assignee: Scott Paper Company, Philadelphia, Pa.

[22] Filed: May 21, 1974

[21] Appl. No.: 472,072

[52] U.S. Cl. ..... 428/90; 428/245; 428/253; 428/296; 428/373; 428/374; 428/378; 428/380; 428/392

[51] Int. Cl.[2] ..... B05D 1/14; B05D 1/16; B32B 33/00

[58] Field of Search ..... 161/64, 67, 88, 89, 161/55, 57, 59, 60, 143, 150–153, 155–157, 170, 175, 176; 117/16, 26, 28, 166; 428/90, 245, 253, 296, 373, 374, 375, 378, 380, 392, 397; 427/206

[56] References Cited

UNITED STATES PATENTS

| | | | |
|---|---|---|---|
| 3,347,727 | 10/1967 | Bobkowicz | 156/244 |
| 3,382,662 | 5/1968 | Seelig | 117/28 X |
| 3,567,545 | 3/1971 | Bobkowicz | 156/229 |
| 3,583,890 | 6/1971 | Kolckmann | 161/67 X |
| 3,808,087 | 4/1974 | Milewski | 161/176 |

*Primary Examiner*—Marion E. McCamish
*Attorney, Agent, or Firm*—Martin L. Faigus; William J. Foley

[57] ABSTRACT

The flocked filamentary element of this invention is a three-component system including: (1) a strength-imparting component in the form of a core-strand having a denier no greater than 40, and including at least one polymeric filament; (2) an adhesive component adhering the filaments of the core-strand together (when the core-strand includes more than one filament), and providing a layer around the periphery of the core-strand; and (3) an outer flock of substantially individualized cellulosic fibers, such as wood pulp fibers, adhered to the adhesive layer. The individualized cellulosic fibers have an average fiber length in the papermaking range, i.e., less than one-quarter inch (6.35 millimeters) and greater than about one millimeter, and constitute over 50% of the weight of the filamentary element. Fibrous structures, such as non-woven webs, woven webs, knit fabrics and yarns, formed from a plurality of the filamentary elements also constitute a part of the invention.

18 Claims, 11 Drawing Figures

Fig. 1
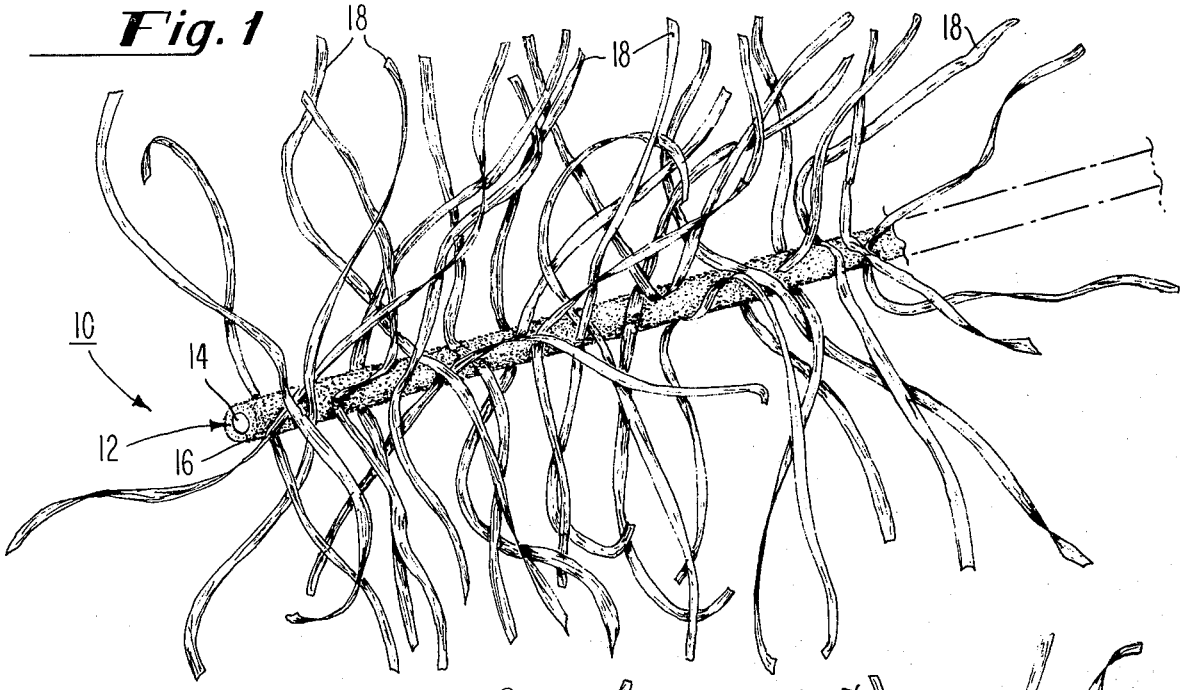
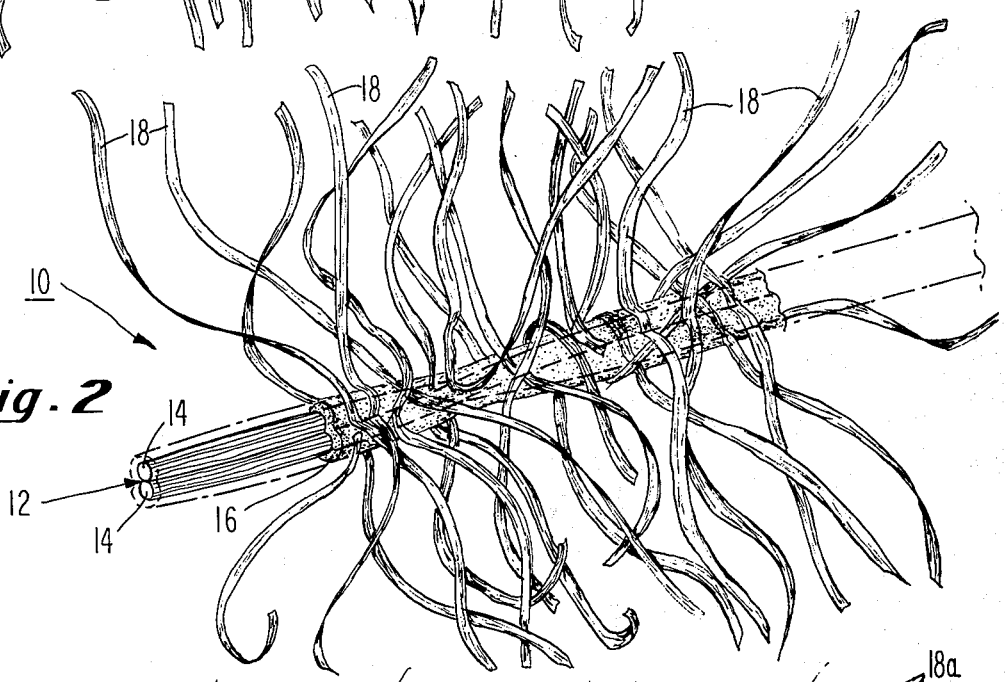
Fig. 2
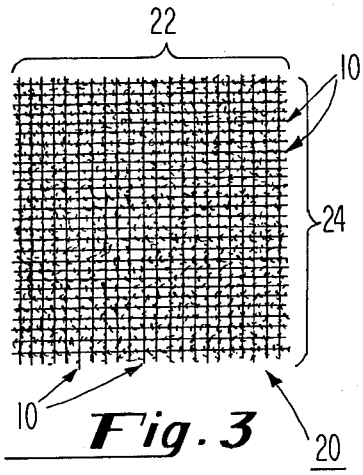
Fig. 3
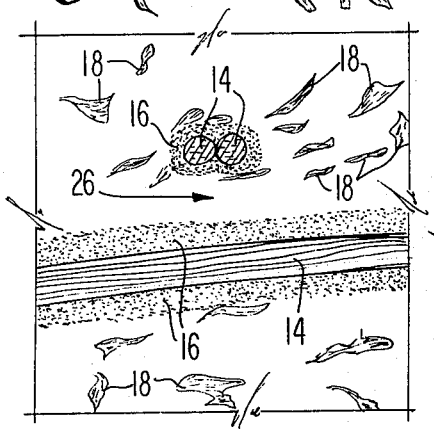
Fig. 7
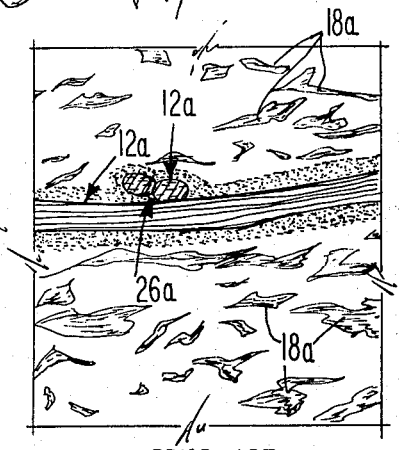
PRIOR ART
Fig. 8

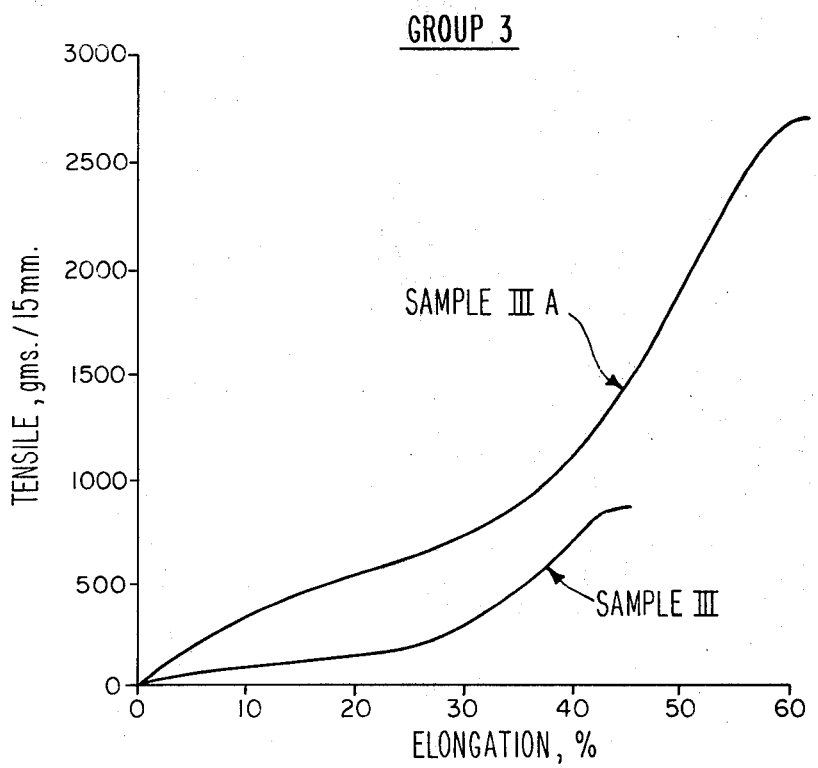
Fig. 6
Fig. 11
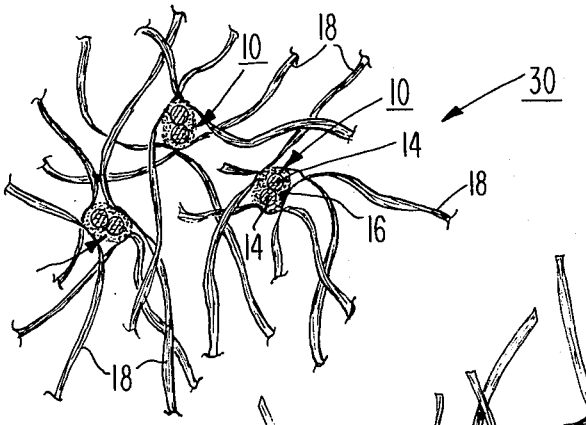
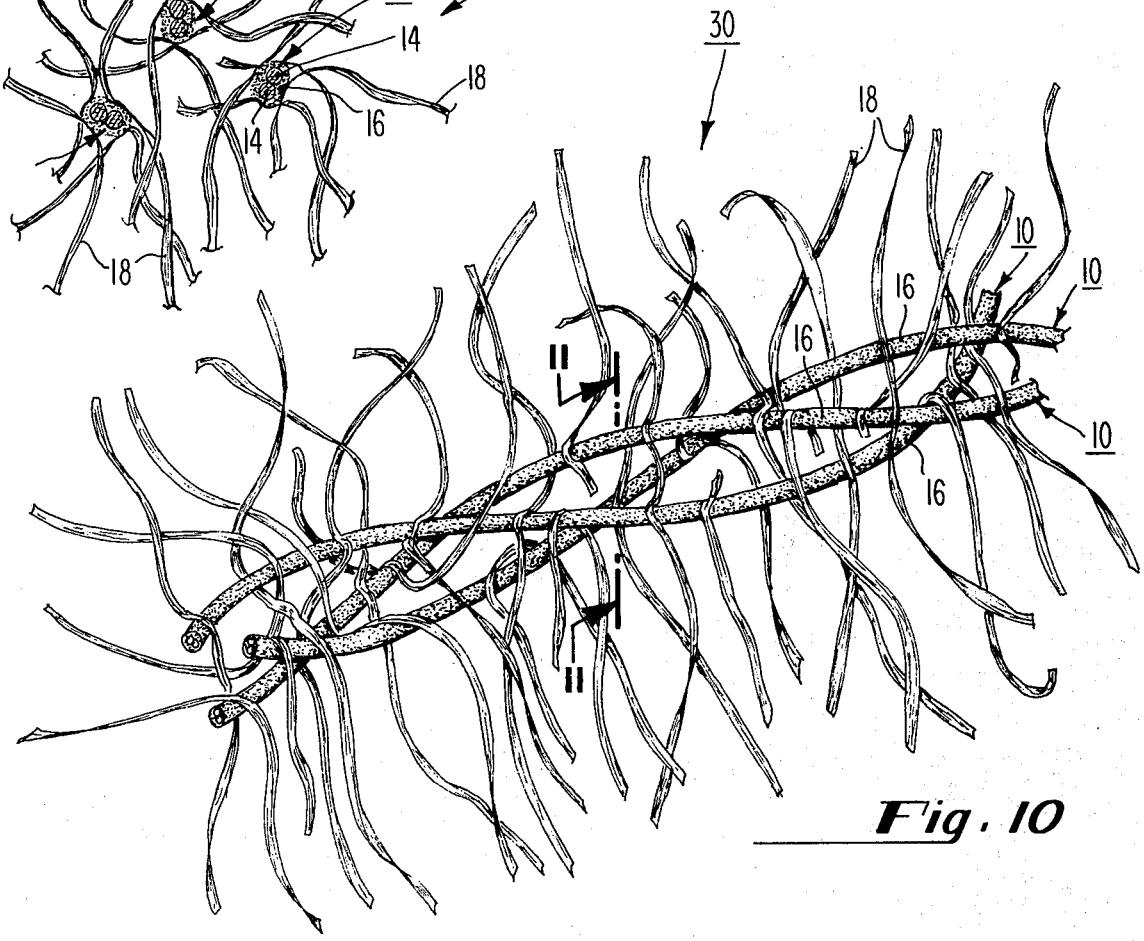
Fig. 10

FLOCKED FILAMENTARY ELEMENT AND STRUCTURES MADE THEREFROM

BACKGROUND OF THE INVENTION

1. Field of the Invention

This invention relates generally to a flocked filamentary element, and to fibrous structures formed from a plurality of said filamentary elements. More specifically, this invention relates to flocked filamentary elements including a major proportion by weight of substantially individualized cellulosic fibers of a papermaking length less than one-quarter inch (6.35 millimeters, and to fibrous structures, such as webs and yarns, suitable for use as substitutes for textile structures which include only textile-length fibers or continuous filaments.

The term "flock", "flocked" or "flocking", as used in describing the inventions set forth in this application, refers to the random adherence of the individualized cellulosic fibers, at any location along their lengths, to an adhesive layer on the surface of a core-strand, as well as to the adherence of only ends of such fibers to the adhesive layer in an aligned array.

2. Description of the Prior Art

Considerable activity has existed in the general area of flocking various substrates with substantially individualized fibers, as evidenced by the existence of numerous patents in this field. Much of this activity is unrelated to the field of textile substitutes which forms the subject matter of this invention.

The textile substitutes of this invention have an appearance simulating that of conventional textile structures that are formed from 100% textile-length fibers by conventional spinning, knitting or weaving operations. In addition, the textile substitutes of this invention have a balance of comfort factors; such as handfeel, drape, absorbency, elasticity and softness; along with the requisite strength to permit their use, either alone, or in combination with other elements, as towels, wipers, wearing apparel, cover materials for sanitary products such as diapers and sanitary napkins, and the like. Moreover, the textile-substitutes of this invention are inexpensive as compared to conventional textile structures made from 100% textile-length fibers, and therefore, can be adapted for either single, or limited use applications to compete in the disposable products market.

It has been suggested in U.S. Pat. No. 2,053,123, issued to Alles, to form an artificial thread including a high strength, high denier (175–275) core-strand flocked with short fibers, such as wood pulp. The artificial thread is used as a reinforcement for such materials as vulcanized rubber in the manufacture of tires. Alles suggests that the flocking associated with the core-strand provides better anchorage to the rubber than conventional yarns which are not flocked. This patent is concerned solely with achieving improved anchorage between the artificial threads and materials to be reinforced thereby. There is absolutely no suggestion of achieving a balance between appearance, strength, and comfort factors to form the textile substitutes of this invention. In fact, the high denier core-strand, while adequately serving as a high strength reinforcing member, does not provide the balance of comfort factors associated with the textile substitutes of this invention.

It has been suggested to form a scrim, or web product provided with a light fiber applique for use as a cover material for sanitary napkins. U.S. Pat. No. 2,900,980, issued to Harwood, and assigned to Kimberly-Clark Corporation, is one of several patents assigned to Kimberly-Clark which are representative of this type of construction. This construction has a soft surface feel as a result of the fiber applique; however, the major proportion by weight of the Harwood construction is the textile-length fibers forming the scrim. Therefore, this construction is more expensive to manufacture than a web product in which the major proportion of the fibers are relatively inexpensive cellulosic fibers of a papermaking length less than one-quarter inch (6.35 millimeters), such as wood pulp fibers and cotton linters. Moreover, the Harwood construction has a relatively low bulk,, and is therefore not suitable for use in applications in which high bulk is either required or desired. Also, and most important, the bonding at the junctions between the cross-laid threads making up the scrim of the Harwood construction tends to restrict relative movement between the threads at these bonded junctions. When the threads forming the scrim are close together (which is highly desirable to form an opaque web construction) the bonded junctions will also be close together and adversely restrict relative movement between the threads. This restriction in relative movement between the threads is evidenced by a higher initial modulus of elasticity than a conventional woven or knitted construction in which frictional movement between threads at their points of crossing is permitted to take place. The higher modulus is reflected in a stiffer product having less drape than a conventional woven or knitted construction.

A flocked web structure has also been suggested for use as an underlay for mats. U.S. Pat. No. 3,583,890, issued to Kolckmann, is representative of such a construction, and relates to an underlay which is placed between a mat and a deep-pile carpet to prevent slippage of the mat on the carpet. The underlay is in the form of a lattice-like structure formed from such materials as textile threads, paper threads, metal wires, and the like. This lattice structure is provided on one side with a non-slip coating, and on the other side with a flocking of textile fibers. The flocking is adapted to dig into the pile of the carpet to prevent slippage of a mat positioned on top of the underlay. This patent is concerned with preventing slippage between a mat and a deep-pile carpet, and is not at all concerned with achieving a balance of appearance, strength and comfort factors to form the textile substitutes of this invention. In fact, Kolckmann does not suggest parameters for the various components making up his lattice construction for achieving a balance among appearance, strength and comfort factors.

Flocked filamentary elements in the form of yarns are disclosed in U.S. Pat. Nos. 3,347,727 and 3,567,545, both of which are issued to Bobkowicz et al. These disclosures are devoid of any teaching of optimum quantities of components to achieve a balance among appearance, strength and comfort factors achieved in the textile-substitutes of the instant invention.

A discussion of yarns made by Bobkowicz is set forth in an article entitled, "Some Structural and Physical Properties of Yarn Made on the Integrated Composite Spinning System", appearing in Textile Research Journal, March 1974, Volume 44, Number 3, pp 206–213. The yarns disclosed in this article all include less than 50% by weight stable length fiber flock adhered by adhesive layers to multifilament core-strands having deniers of at least about 100. These yarns do not have a balance of strength and comfort factors achieved by the practice of applicant's invention.

It is suggested in British Pat. No. 1,228,325, assigned to Kendall, to provide an opaque web construction by including ultra short fibers, i.e., 50–300 microns in length, in a fibrous web of textile fibers. This patent does not suggest forming textile substitutes from any flocked filamentary elements, let alone filamentary elements including a preponderance of short, substantially individualized fibers of a papermaking length less than one-quarter inch (6.35 millimeters) and greater than about one millimeter. In fact, the ultra short fibers employed in the construction disclosed in the British patent are considerably shorter than the fibers which can be satisfactorily employed in the instant invention.

SUMMARY OF THE INVENTION

This invention relates to a flocked filamentary element in the form of a three-component system including: (1) a strength-imparting component in the form of a core-strand having a denier no greater than 40, and including at least one polymeric filament; (2) an adhesive adhering the filaments together (when the core-strand includes more than one polymeric filament), and providing a layer around the periphery of the core-strand; and (3) substantially individualized cellulosic fibers having an average fiber length less than one-quarter inch (6.35 millimeters) and no less than about one millimeter providing a fiber flock on the surface of the filamentary element, and retained as part of the filamentary element by the adhesive layer. The individualized cellulosic fibers are relatively inexpensive as compared to the polymeric filaments forming the core-strand, and these short fibers constitute over 50% of the weight of the filamentary element.

This invention also relates to textile-substitutes; such as yarns, non-woven webs, woven webs and knitted fabrics; all of which include a plurality of closely spaced and/or crossing filamentary elements adhered together by means of their respective adhesive layers. The non-woven webs, woven webs and knitted fabrics can be constructed from a plurality of individual flocked filamentary elements which are adhered together by means of their respective adhesive layers, or alternatively a plurality of the filamentary elements can first be combined by means of their respective adhesive layers into yarns, and the webs and fabrics then constructed from such yarns. The textile substitutes of this invention are high in bulk and have a pleasing surface feel and appearance.

The low denier (less than 40) core-strand is relatively flexible and well suited for use in the textile substitutes of this invention. Also, core-strands having a denier of less than 40 and including adhesive therewith can easily be flocked in a continuous process to form a flocked filamentary element in which the weight of the short, substantially individualized cellulosic fibers constitutes over 50% of the weight of the filamentary element.

The inclusion of a preponderance of the short cellulosic fibers in the filamentary element of this invention, which fibers are considerably cheaper than textile fibers, is responsible for the excellent economics associated with the products of this invention. Moreover, the short cellulosic fibers provide a pleasing appearance and excellent surface feel both to the filamentary element, and to the textile substitutes formed therefrom. Applicant has also found that satisfactory flocking cannot be achieved when the short cellulosic fibers are less than about one millimeter in length, since fibers below about one millimeter in length have properties similar to dust, and do not provide an aesthetically pleasing appearance and surface feel to the filamentary element.

Applicant has found that textile substitutes formed from a plurality of the flocked filamentary elements of this invention have improved textile properties as compared to web structures in which textile length fibers, or continuous filaments are adhesively bonded together to form a web construction prior to flocking. Specifically, applicant has found that the web constructions including a plurality of flocked filamentary elements of this invention that are bonded together have greater freedom of movement than web constructions made from unflocked filaments. This greater freedom of movement is believed to be directly translatable into enhanced comfort factors, such as drape and conformability, and is similar to the freedom of movement permitted by the frictional engagement between fibers or filaments in unbonded textile structures made by conventional spinning, weaving or knitting techniques.

Other objects and advantages of this invention will become apparent upon reading the detailed description of this invention which follows, taken in conjunction with the drawings.

BRIEF DESCRIPTION OF THE DRAWINGS

FIG. 1 is a fragmentary perspective view of a flocked filamentary element of this invention;

FIG. 2 is a fragmentary perspective view showing a different version of a flocked filamentary element of this invention with portion of the adhesive broken away for clarity;

FIG. 3 is a plan view of a non-woven cross-laid fibrous web structure of this invention;

FIGS. 4, 5 and 6 are graphs comparing the stress-strain relationships between three cross-laid fibrous webs of this invention and similar prior art cross-laid fibrous webs, respectively;

FIG. 7 is a sectional view taken through a horizontally extending filamentary element of FIG. 3 showing a representative structure arising at the crossing of this filamentary element with a longitudinally extending filamentary element;

FIG. 8 is a view similar to FIG. 7, but showing a representative structure existing at the crossing of filamentary elements in a prior art non-woven cross-laid fibrous web which was flocked after web formation;

FIG. 10 is an isometric view of a yarn made from a plurality of flocked filamentary elements of this invention; and FIG. 11 is a cross-sectional view along line 11—11 of FIG. 10.

DESCRIPTION OF THE PREFERRED EMBODIMENTS OF THE INVENTION

Figure 4:
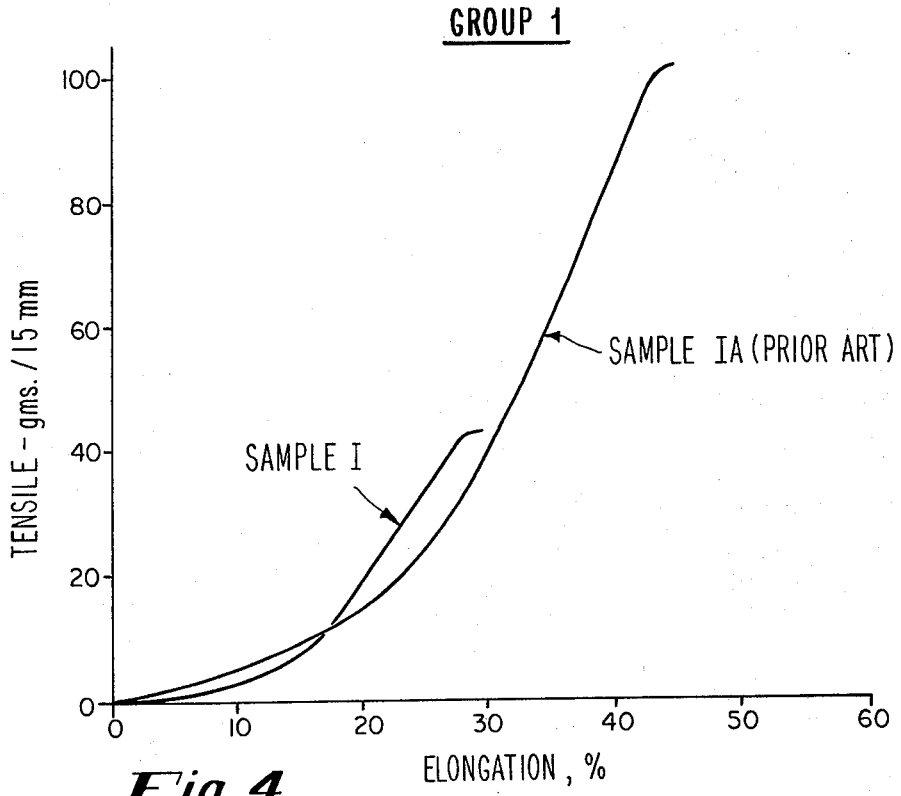

Referring to FIG. 1, a flocked filamentary element 10 of this invention is a three-component system including: (1) a core-strand 12 including at least one polymeric filament 14; (2) a polymeric adhesive 16 coating the core-strand; and (3) an outer flocked layer of substantially individualized cellulosic fibers 18 of a papermaking length less than one-quarter inch (6.35 millimeters) adhered to the core-strand 12 by the adhesive 16.

The core-strand 12 can include more than one polymeric filament 14, and in the embodiment shown in FIG. 2 includes two such polymeric filaments. When the core-strand 12 includes more than one polymeric filament the adhesive 16 also functions to hold the polymeric filaments of the core-strand together. The core-strand 12 is the strength-imparting element of the filamentary element 10 and of the textile substitutes manufactured from a plurality of said filamentary elements.

The substantially individualized cellulosic fibers 18 provide a pleasing textile-like feel and appearance to the filamentary elements 10, and also to the textile substitutes manufactured therefrom. The preferred cellulosic fibers 18 are wood pulp or cotton linters because they are absorbent, readily available and inexpensive compared to textile fibers.

"Textile fibers", as referred to in this application, are fibers which have a textile-length over one-quarter inch (6.35 millimeters) and which can be handled in conventional textile operations such as spinning, weaving or knitting to form textile fabrics. By including a major proportion by weight of the short, substantially individualized cellulosic fibers 18 in the filamentary element 10 of this invention, said filamentary element is considerably less expensive than a filamentary element of comparable weight formed from only textile-length fibers. Accordingly, textile substitutes manufactured from a plurality of the filamentary elements 10 of this invention are also considerably less expensive than conventional textile structures employing only textile-length fibers. Moreover, for many products, such as wipers, towels and wearing apparel, absorbency is an important characteristic. As stated earlier, the preferred short cellulosic fiber flock (wood pulp or cotton linters) is absorbent, and therefore its inclusion in the filamentary element 10 and textile substitutes of this invention enhances the absorbency characteristics thereof. The strength properties of the filamentary element 10 and textile substitutes made therefrom are dictated by the particular core-strand material which is employed.

The adhesive 16 of the filamentary element 10 is a polymeric adhesive, and is preferably soft and flexible to retain soft, flexible properties of said filamentary element, and also of the textile substitutes manufactured from a plurality of said flocked filamentary elements. The adhesive 16 can be of the reactivatable type, preferably by heat, i.e., it can be rendered tacky by heating after it has been set in the process of manufacturing the flocked filamentary elements 10. When the adhesive is reactivatable the flocked filamentary elements can be wound into packages and stored for subsequent shipment to a converter for ultimate fabrication into textile substitutes of this invention. To further explain, a converter can employ the flocked filamentary elements 10 in a continuous process in which the adhesive of the filamentary elements is first reactivated to render it tacky, and the flocked filamentary elements 10, with the adhesive in a tacky condition, assembled into structures by a number of techniques (e.g., cross-laying, carding, random-laying, knitting, weaving, etc.), and consolidated to form textile substitutes in which the filamentary elements 10 are held together, at least in part, by the adhesive 16 associated with the individual flocked filamentary elements 10.

When textile substitutes of this invention are formed as a continuous process extension of the process in which the flocked filamentary elements 10 are formed, the adhesive does not have to be of the reactivatable type. To further explain, in a continuous process, as described above, the adhesive 16 can be only partially set or cured in the manufacture of the flocked filamentary elements 10 to retain a tacky condition after flocking, and the filamentary elements 10 can be immediately assembled into the textile substitutes of this invention. After consolidation the adhesive 16 can be completely set or cured.

The specific adhesive which is utilized in this invention will depend on the specific use contemplated for the flocked filamentary elements, and therefore, the specific adhesive utilized is not considered to limit the invention. Exemplary heat reactivatable polymeric adhesives which may be employed in this invention are vinyl acetate homopolymers and copolymers, and other adhesives formed from thermoplastic polymers, such as polyethylene, polypropylene, polyamides, acrylics and cellulose acetate. Exemplary nonreactivatable polymeric adhesives which may be employed in this invention are urethane adhesives, polybutadiene adhesives, acrylic copolymers, vinyl acetate copolymers, and other cross-linked polymers.

Non-Woven Cross-Laid Webs

Referring to FIG. 3, a non-woven cross-laid web 20 of this invention includes a plurality of the flocked filamentary elements 10. This non-woven web 20 includes two plies 22 and 24. The flocked filamentary elements 10 within each ply 22 and 24 are aligned in the same direction, and the plies 22 and 24 superimposed upon each other such that the flocked filamentary elements 10 in one ply are disposed 90° to the flocked filamentary elements 10 of the other ply. The number of flocked filamentary elements included in each ply is a matter of choice; however, exemplary webs of this invention have included 7 and 14 flocked filamentary elements per inch within each ply. Also, the number of plies included in the non-woven cross-laid web is considered to be a matter of choice.

Applicant has discovered that the non-woven cross-laid webs of this invention have a superior balance of textile-like properties than prior art non-woven cross-laid webs formed from adhesively bonded textile length threads which are flocked with substantially individualized wood pulp fibers after the textile fibers have been consolidated by adhesive bonds into a cross-laid lattice construction. Specifically, the non-woven cross-laid webs of this invention have a better balance between strength and flexibility than do the prior art cross-laid webs in which the textile threads are flocked subsequent to web formation. This better balance between strength and flexibility properties is reflected by a lower diagonal initial modulus of elasticity (the initial slope of a stress strain curve) in applicant's web constructions than in the prior art web constructions. The testing procedure for determining the balance between strength and flexibility in cross-laid webs of this invention and the prior art cross-laid webs will be explained later.

The lower diagonal initial modulus of the non-woven cross-laid webs of this invention is a good indication that the bonds retaining the separate plies together permit a greater freedom of movement between filamentary elements than the adhesive bonds in the prior art non-woven webs which are flocked after the strands are bonded together into a web structure. This greater freedom of movement is believed to be responsible for improved comfort factors such as conformability, handfeel and drape. In fact, applicant believes that the freedom of movement in the non-woven cross-laid webs of this invention can be likened to the freedom of movement permitted by the frictional engagement between threads or yarns in conventional textile products formed by weaving or knitting. In other words, one aspect of applicant's invention resides in achieving bonded structures in which the bonds adhering the flocked filamentary elements 10 together permit a freedom of movement between these elements closely approximating the behavior permitted by the frictional engagement between threads in conventional textile constructions.

Testing Procedure for Determining Bond Behavior

Flocked filamentary elements 10 of this invention were made from the following components:

| | |
|---|---|
| (1) core-strand 12 | - DuPont Nylon, 14 denier, 2 filament (7 denier/filament), ¼ turn/inch, Z twist, and identified as 14-2-¼Z -280-S.D. |
| (2) adhesive 16 | - 100% by weight add-on, Thylon D-406, a urethane adhesive manufactured by Thiokol Chemical Corporation of Trenton New Jersey. |
| (3) flock fibers 18 | -75% by weight Soundview West Coast sulfite wood pulp having an average fiber length of about 2.8 millimeters. |

The present adhesive add-on is the weight percent of adhesive relative to the core-strand, and is calculated by the following formula:

$$(Wc{+}a/Wc) \times 100,$$

where:

$Wc{+}a$ = weight of core-strand plus adhesive;

and $Wc$ = weight of core-strand.

All references in this application to the percent of adhesive add-on refers to the weight percent of adhesive 16 relative to the core-strand 12 as calculated by the above formula.

The percent flock fibers 18 is the weight percent based on the total weight of the filamentary element 10, and is calculated by the following formula:

$$\frac{(\mathrm{Wt} - Wc + a)}{(\mathrm{Wt})} \times 100, \text{ where:}$$

Wt = total weight of the flocked, filamentary element 10; and

Wc+$a$ = weight of core-strand plus adhesive. All references in this application to the weight percent of the flock fibers 18 relates to the weight percent based on the total weight of the filamentary element 10, and is calculated by the above formula.

The above filamentary elements 10 were assembled into the following three non-woven cross-laid web structures:

Sample I - (a) two-plies, (b) 7 flocked filamentary elements per inch in each ply, (c) flocked filamentary elements within each ply aligned in the same direction, and (d) filamentary elements in adjacent plies aligned 90° to each other.

Sample II - (a) 8 plies, (b) 7 flocked filamentary elements per inch in each ply, (c) flocked filamentary elements within each ply aligned in the same direction, (d) flocked filamentary elements in adjacent plies aligned 90° to each other.

Sample III - same as Sample II, except each ply contained 14 flocked filamentary elements per inch.

The above three samples represent non-woven cross-laid webs of this invention.

The compare the behavior of the non-woven cross-laid webs of this invention with the prior art-type of constructions three additional samples were constructed. First, filamentary elements were prepared from the same Nylon core-strand employed in the above three samples by coating the core-strand with 50% adhesive add-on of Thylon D-406. These filamentary elements, prior to flocking, were assembled into three different non-woven cross-laid structures which corresponded exactly in the number of plies, and the number of filaments per inch within each ply, to the above described Samples I, II and III, respectively. After these three non-woven cross-laid structures were formed an additional 50% by weight of Thylon D-406 was added to the web (25% by weight on each side of the web), and loosely compacted wood pulp fluff mats formed from the same Soundview West Coast sulfite pulp as employed in the instant invention were pressed against the non-woven webs to adhere the wood pulp thereto. Non-adhered wood pulp fibers were removed by air jets. The flocking process yielded approximately 83% by weight wood pulp fibers in the completed prior art-type non-woven cross-laid web constructions.

Both the non-woven cross-laid webs of this invention, and the prior art-type non-woven webs were tested on the Instron Universal Testing Instrument, Model TM, by cutting out discrete sections of the webs and testing them for tensile strength, elongation and initial modulus characteristics in a diagonal direction (i.e. 45° to the orientation of the filamentary elements in all plies) by the following procedure which is outlined in ASTM D1682-64. Diagonal strips were cut to 15 millimeter widths, and stress-elongation curves generated with a 2 inch gap, a 2 inch/minute cross-head speed and a 10 inch/minute chart speed. The cell used and the full scale calibration was appropriate to the strength of the sample. The tensile strength and elongation at break were determined by the maximum point on the generated curve. The initial modulus was determined by calculating the slope of a line drawn tangent to the initial portions of the curves. All values reported represent the average of 10 determinations.

The properties observed in the above diagonal testing procedure are indicative of the properties of the bonds holding the plies together, rather than the strength and elongation characteristics associated with the core-strands of the filamentary elements.

The results of the above testing procedure are shown in Table I, wherein the prior art-type non-woven constructions having the same number of plies and filaments per ply as Samples I, II and III are identified as Samples IA, IIA and IIIA, respectively.

TABLE I

| Group | Construction | Basis Weight (lbs/2880 ft²) | DIAGONAL PROPERTIES Tensile at Break (grams) | Elongation at Break % | Initial Modulus (grams/%)* |
|---|---|---|---|---|---|
| 1 | A. Sample I | 4.2 | 42 | 18 | .17 |
| | B. Sample IA | 16.6 | 107 | 32 | .31 |
| 2 | A. Sample II | 17.1 | 555 | 44 | 8.2 |
| | B. Sample IIA | 37.4 | 982 | 55 | 15.4 |
| 3 | A. Sample IIIA | 27.8 | 868 | 47 | 10.2 |
| | B. Sample IIIB | 39.8 | 2670 | 62 | 48.5 |

*Initial slope of the stress-strain curves (Figs. 4 – 6) generated on the Instron Universal Testing Instrument.

Figure 5:
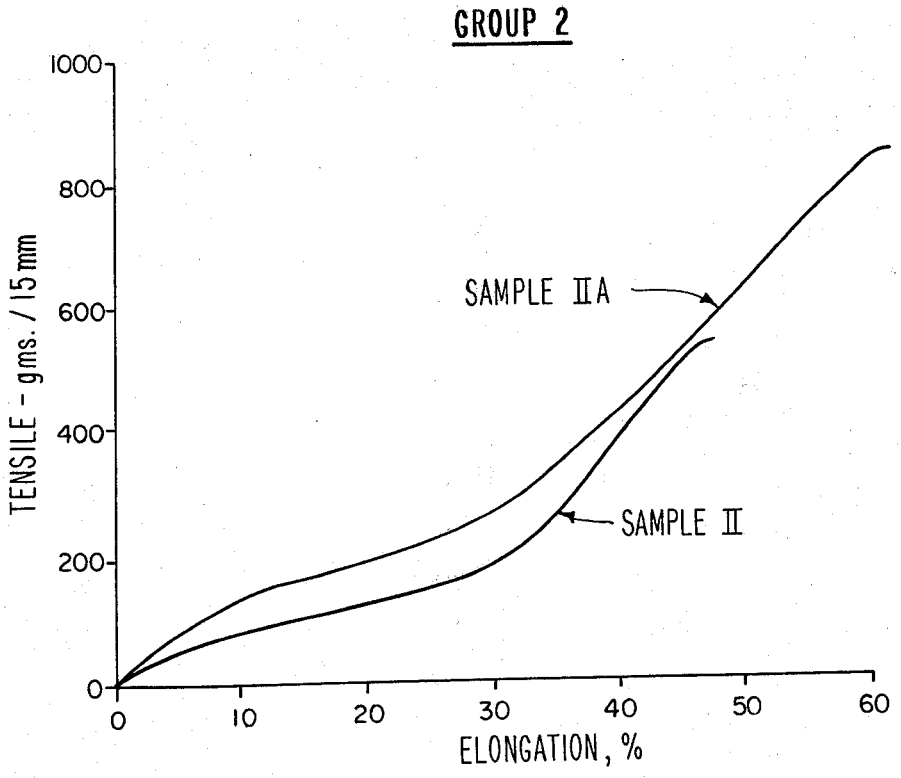

FIGS. 4, 5 and 6 are the stress-strain curves which were generated by the Instron Universal Testing Instrument in the testing of the webs of Group 1, Group 2 and Group 3, respectively, which are identified in Table I. As can be seen from all these graphs the initial slopes for the non-woven cross-laid webs of this invention (Samples I, II and III) are lower than the initial slopes of the corresponding prior art non-woven webs (Samples IA, IIA and IIIA). These lower initial slopes are reported as the initial modulus in Table I. Accordingly, as stated earlier, the non-woven cross-laid webs of this invention have enhanced flexibility as compared to the prior art constructions formed by flocking a fibrous web after web formation.

Microscopic Analysis of Bond Junctions

The web constructions identified in Table I were sectioned parallel to one set of core-strands, and through them longitudinally. Because of the 90° relationship between adjacent plies, the crossing core-strand 12 of an adjacent ply is shown in transverse cross-section (FIG. 7). The cross-sections were taken in the manner indicated for the purpose of investigating the structure at the crossing points between the filamentary elements 10 in adjacent plies to determine whether a different structural relationship existed between the filamentary elements 10 in the non-woven cross-laid webs of this invention, and the filamentary elements in the prior art non-woven cross-laid webs which were flocked after web formation.

When sectioning the webs to microscopically investigate the structural relationship at the crossing junctions it is important to stabilize the construction prior to sectioning so that the structural relationship of elements is not materially disturbed by the sectioning operation. In order to achieve this result all of the samples to be sectioned were dipped in partially polymerized n-butylmethacrylate. The samples were then air dryed for three days at ambient temperature (this reduced the shrinkage of the product and of the methacrylate). The resultant air dryed strips were then placed in gelatin capsules. The capsules were filled with uninhibited n-butylmethacrylate containing approximately 0.1 % uninhibited n-methylmethacrylate monomer and 1% benzoyl peroxide catalyst. The capsules were then placed in an oven at 56°–58°C for at least 16 hours to effect complete polymerization. After polymerization was complete the capsules were removed and the samples were in a stabilized condition ready for sectioning.

FIGS. 7 and 8 are schematically representative of the structure existing at a majority of the crossing junctions of the filamentary elements in the cross-laid webs of this invention (Samples I, II and III), and in the prior art cross-laid webs (Samples IA, IIA and IIIA), respectively. Referring to FIGS. 3 and 7, the spacing between the core-strands 12 of adjacent plies 22 and 24 at their crossing junction 26 is exceedingly large. At more than 50% of the crossing junctions the spacing is greater than a core-strand diameter, and at many of these crossing junctions the spacing is greater than twice the core-strand diameter. Reference throughout this application, including the claims, to "spaced junctions", refers to junctions in which the crossing core-strands are greater than a core-strand diameter apart. Furthermore, over 50% of the crossing junctions 26 include flock fibers 18 disposed therein.

FIG. 7 shows the distribution of adhesive layers 16 observed at most of the spaced junctions. At some of the spaced junctions 26 the adhesive associated with adjacent filamentary elements is connected; however, not through a continuous, uninterrupted mass of adhesive disposed throughout the entire crossing junction area. Regardless of the specific adhesive distribution in the non-woven webs of this invention, the core-strands 12 in adjacent plies are spaced a considerable distance apart at a majority of the crossing junctions 26, and this large spacing is greater than can be accounted for by the existance of the adhesive thickness associated with each of the core-strands 12. This large spacing is believed to be responsible for the bond flexibility exhibited in the products of this invention.

The exact reason for the large spacing between core-strands at crossing junctions 26 is not understood. However, it is postulated that the flocking fibers 18 associated with the adjacent filamentary elements 10 at the crossing junctions prevent the adhesive associated with these adjacent filamentary elements from intimately and uniformly adhering to each other, and in some cases, completely prevent the adhesive associated with the respective filamentary elements from bonding together at all. At the crossing junctions 26 in which the adhesive layers associated with respective core-strands 12 are completely separate it is postulated that the flock fibers 18 act as a flexible bridge between the adhesive layers to affect the bonding.

FIG. 8 shows a typical relationship between crossing core-strands **12*a* at a majority of the crossing junctions in the prior art structures. These structures were formed by flocking the adhesively coated core-strands after formation of the lattice structure. As can be seen in FIG. 8, the core-strands 12*a* in adjacent plies are extremely close to each other at the crossing junctions 26*a*, and do not include flock fibers 18*a* between them. This close relationship between the core-strands 12*a*** is believed to be responsible for the lower degree of flexibility (i.e., higher initial modulus) in the prior art structures than in the structures of the instant invention.

Percent Flock Fibers in Filamentary Element 10

By a test procedure subsequently to be applicant has found that non-woven cross-laid webs of this invention which have a desirable balance between appearance characteristics, strength characteristics, and comfort characteristics, should be formed from flocked filamentary elements 10 including over 50% by weight of the substantially individualized cellulosic fibers 18.

Applicant has found that textile-substitutes, such as cross-laid webs, can consistently be formed with over 50% of the crossing junctions being spaced junctions when the flocked filamentary elements include over 50% by weight of the short cellulosic fibers 18.

Preferably, the weight percent of these cellulosic fibers should be over 60% and most preferably over 75%. Also, from a cost standpoint it is highly desirable to employ a large percentage by weight of low cost flock fibers in a web structure, and applicant's invention permits the inclusion of a large percentage by weight of short, substantially individualized cellulosic fibers 18 while at the same time achieving an excellent balance of textile-like properties, such as opaqueness, softness, strength, drape and conformability.

Test Procedure for Determining Required Percent Flock Fibers 18 in Filamentary Element 10

Flocked filamentary elements were made of the same core-strand, adhesive and short cellulosic flock fibers as in the testing procedure employed for determining bond behavior, with the exception that the percent wood pulp fibers 18 in the flocked filamentary elements was varied so that non-woven cross-laid webs could be manufactured with varying percentages of flock fibers 18 associated therewith.

Applicant constructed six non-woven cross-laid webs, each of which included eight plies. Each ply had fourteen filamentary elements per inch which were aligned in the same direction, and the plies were adhered together with the filamentary elements in adjacent plies aligned 90° to each other. The only difference between the filamentary elements in each of the six structures was the weight percent of short cellulosic fibers 18 associated with the filamentary elements utilized to form the structures. Each of the six samples were physically tested to determine diagonal tensile strength, diagonal elongation and diagonal initial modulus in the same manner as described earlier in connection with the results reported in Table I, and all samples were microscopically examined in the same manner as described earlier in connection with the results reported in FIGS. 7 and 8. The results of the physical testing of the six non-woven cross-laid web samples is set forth in Table II below:

TABLE II

| Sample | Wood Pulp (%) | Basis Weight (lbs/2,880 ft²) | DIAGONAL PROPERTIES Tensile (grams) | Elongation (%) | Initial Modules (grams/%) |
|---|---|---|---|---|---|
| 1 | 0.0 | 6.1 | 473 | 42 | 0.26 |
| 2 | 18.7 | 10.5 | 678 | 47 | 3.3 |
| 3 | 36.7 | 12.5 | 1071 | 52 | 6.0 |
| 4 | 56.7 | 18.5 | 1405 | 55 | 7.7 |
| 5 | 62.3 | 20.4 | 868 | 50 | 10.4 |
| 6 | 69.5 | 27.0 | 486 | 42 | 7.5 |

Figure 9:
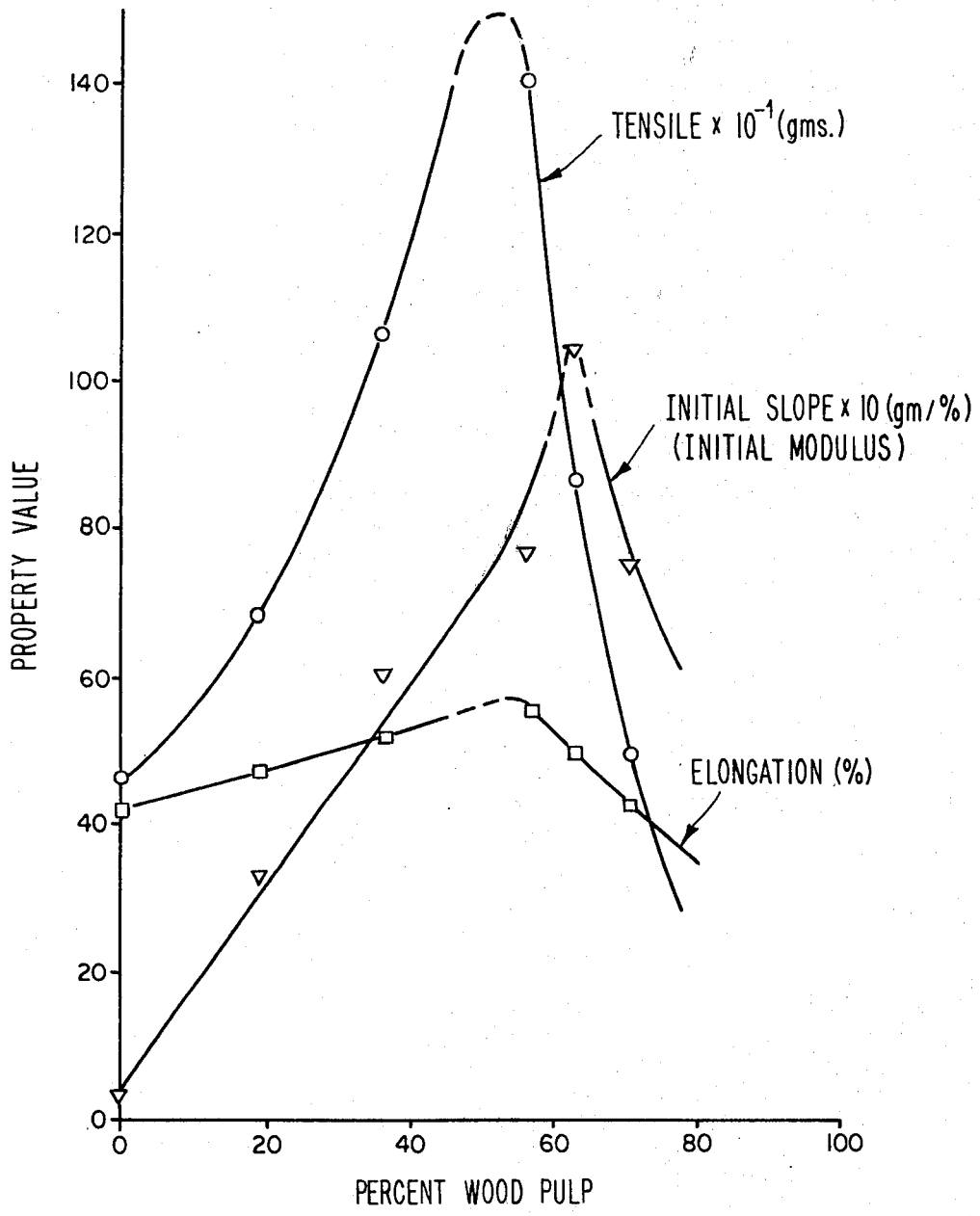
FIG. 9 is a graphic representation indicating the relationship of various diagonal physical properties of cross-laid webs as a function of the weight percent of flock fibers of the filamentary elements.

A plot of diagonal tensile strength, diagonal elongation and diagonal initial modulus versus percent wood pulp fibers 18 is shown in FIG. 9. All of these properties show a reversal, or peak between about 50% and about 60% by weight wood pulp fibers. This peak, in all measures, represents a change in relationship from increasing strength and decreasing softness to decreasing strength and increasing softness of the bonded junctions. This data indicates that the non-woven cross-laid webs of this invention become more paper-like (harsher and less soft) as the percent of wood pulp is increased up to about 50 to about 60%; and that this trend is reversed as the percentage of wood pulp is increased above this level. At wood pulp percentages greater than from about 50 to about 60% the non-woven cross-laid web structures increase in softness, and decrease in diagonal strength which is consistent with the characteristics of woven textile construction. Applicant has found that when the weight percent of wood pulp fibers is in excess of 75% a highly desirable balance of textile properties is achieved. Therefore, applicant has discovered that textile-like web products can be manufactured from filamentary elements 10 employing a preponderance by weight of relatively cheap, short cellulosic fibers 18 to form constructions which can be adapted for single or a limited use to compete in the disposable products market against fabrics made from 100% textile fibers or continuous filaments.

Applicant's discovery that textile-like properties can be achieved in web constructions made from filamentary elements including a preponderance by weight of substantially individualized cellulosic fibers of a papermaking length less than one-quarter inch (6.35 millimeters) was somewhat surprising since one would expect that the greater the percent by weight of the short cellulosic fibers 18 included as part of the filamentary elements 10, the more closely the products made therefrom would approach the properties of paper rather than textiles.

Microscopic Properties

Microscopic examination of crossing junctions between the core-strands in Samples 4, 5 and 6 described in connection with Table II was undertaken to determine the percentage of crossing junctions which were spaced junctions. This percentage is reported as "Spaced Junctions" in Table III below.

TABLE III

| Sample | Wood Pulp (%) | Spaced Junctions (%) |
|---|---|---|
| 4 | 56.7 | 61 |
| 5 | 62.3 | 96 |
| 6 | 69.5 | 92 |

Samples 4, 5 and 6 contained over 50% by weight wood pulp fibers 18, and, as explained earlier, a desirable balance of diagonal properties is achieved in structures wherein the wood pulp fibers 18 constitute greater than 50% of the weight of the filamentary elements 10, Therefore, this investigation was undertaken to determine the relationship between enhanced diagonal properties and the spacing between core-strands at crossing junctions.

As can be observed from TABLE III, the samples containing over 50% wood pulp fibers included crossing junctions, the proponderance of which were spaced junctions.

Limitations Relating to Flocked Filamentary Element 10 of the Invention

As stated earlier in this application, the flocked filamentary elements 10 of this invention are three-components systems; namely, (1) a flocking of short, substantially individualized cellulosic fibers 18; (2) a polymeric filament(s) core-strand 12; and (3) a polymeric adhesive 16 to retain the polymeric filaments(s) 14 of the core-strand 12 together and to retain the short cellulosic fibers 18 as a component of the filamentary element 10.

The test results reported in this application indicate that web constructions having textile-like properties are economically achieved when the filamentary element 10 includes over 50% by weight of the short cellulosic fibers 18, and most preferably when the short cellulosic fibers 18 constitute over 75% by weight.

Primarily for purposes of economics and absorbency the flocking fibers are substantially individualized cellulosic fibers of a papermaking length less than one-quarter inch, and include such materials as wood pulp fibers and second cut cotton linters. For example, applicant has achieved good results with Soundview, Pictou and Brunswick pine as the flocking fiber. Groundwood has been found to be less acceptable in this invention.

Applicant has found that ultra short wood pulp fibers having an average fiber length under about one millimeter are too fine to form an acceptable flock surface. For example, applicant was not able to achieve satisfactory results in attempting to flock a core-strand with Solka-floc SW40 and Solka-floc BW200, both of which ae sold by Brown Company of Berlin, New Hampshire. These Solka-floc fibers have an average fiber length below one millimeter, and provided a dusty, powder-type surface on the core-strand 12 which did not enhance surface feel or physical appearance of the filamentary elements or textile-substitutes manufactured therefrom. Reference in the claims to "papermaking length" excludes these ultra short fibers.

The flocked filamentary elements 10 of this invention have a core-strand 12 which includes at least one polymeric filament 14, and the core-strand 12 has a denier no greater than about 40. This upper limit is primarily dictated by the fact that a core-strand having a denier exceeding about 40 cannot easily be flocked in a continuous process with short cellulosic fibers of a papermaking length less than one-quarter inch (6.35 millimeters) to achieve formation of a structure containing over 50% by weight of the flocked fibers. In addition, economics do not justify utilizing core-strands of larger denier, and in fact, the preferred denier range is from about 7 to about 14. The low denier core-strand 12 imparts a desirable balance of strength and flexibility to the flocked filamentary elements 10 of this invention.

It is believed that the core-strand 12 should not include individual filaments 14 with a denier of less than 1.5. This belief is predicated upon an attempt by applicant to flock wood pulp fibers onto a 10 denier-7 filament core-strand. In this construction each filament had a denier of less than 1.5. As the core-strand was fed continuously through a chamber containing an air suspension of wood pulp fibers individual filaments of the core-strand broke and separated from each other to prevent the formation of an acceptable product. Apparently the strength of the individual filaments (which were less than 1.5 denier) was insufficient to permit it to be conveyed through the flocking process in an acceptable manner. Accordingly, it is believed that regardless of the denier of the core-strand, the individual filaments making up the core-strand should preferably have a denier greater than 1.5.

The specific material employed to make the filaments is considered to be a matter of choice, and one skilled in the art can easily determine a suitable filament material to employ in construction a core-strand 12 for a flocked filamentary element 10 of this invention depending upon the intended use and required properties. Applicant has successfully flocked such polymeric filaments as Nylon, polyester and polypropylene.

The flocked filamentary element 10 of this invention must include a proper weight percent of adhesive add-on to permit the filamentary element 10 to retain over 50% by weight of the short cellulosic fibers 18 and preferably over 60% by weight of said short fibers. The percent by weight adhesive add-on required to achieve wood pulp percentages of over 50% is a function to several variables, such as core-strand denier, number of filaments per core-strand, core-strand material, specific adhesive, method of flocking, etc. In a preferred embodiment of this invention an adhesive add-on of from about 30% to about 300% by weight Thylon D-406 was employed in conjunction with a core-strand of 14 denier - 2 filament Nylon (described earlier) to form a flocked filamentary element having from about 70 to about 90% by weight of wood pulp fibers havig an average fiber length of about 2.8 millimeters.

Other Structures of the Invention Employing Flocked Filamentary Elements 10 of this Invention The most extensive investigation relating to fibrous structures made from flocked filamentary elements 10 of this invention was conducted with respect to non-woven cross-laid webs; however, advantages of this invention are achievable in other structures in which a plurality of the flocked filamentary elements 10 of this invention are bonded together by means of their respective adhesive layers. For example, a plurality of flocked filamentary elements 10 can be bonded together, either with or without twisting, to form a multi-filamentary element yarn according to this invention. The yarns can then be combined into non-woven webs, woven webs and/or knitted fabrics as desired.

Referring to FIG. 10, an exemplary yarn 30 according to this invention has a total core-strand denier greater than 40, and includes a plurality of the flocked filamentary elements 10 shown in FIG. 2, each of which has a core-strand denier less than 40. A yarn having a 70 denier core-stand has been constructed according to this invention by individually flocking ten single 7 denier filaments 14 and then bonding these flocked filaments together to form the yarn having a 70 denier core-strand. Alternatively, the 7 denier filaments 14 can be flocked as doublets (i.e., two filaments/core-strand), as shown in FIG. 2, to form five separate flocked filamentary elements each of which has a core-strand denier of 14. These five flocked filamentary elements 10 can then be bonded together to form the yarn having a 70 denier core-strand. By combining a plurality of flocked filamentary elements 10, each of which has a core-strand denier of less than 40, higher denier yarns having greater than 50% short cellulosic fibers 18 can be constructed.

The separate flocked filamentary elements 10 of this invention can be combined into yarns while the adhesive is tacky by pressing them together as a continuous process extension of the flocking operation. Alternatively, when the adhesive is of the reactivatable type, the individual flocked filamentary elements 10 can be stored in a package and shipped to a converter for subsequent processing into yarns. The converter can pass the flocked filamentary elements 10 through a heating chamber, or any other process which reactivates the adhesive to a tacky state, and then assemble and press the flocked filamentary elements 10 together to form the yarns.

Applicant has found that the greater the number of individual flocked filamentary elements 10 utilized to manufacture a yarn of a given denier, the bulkier the yarn which is formed, and in all cases where the core-strand denier of each flocked filamentary element is less than 40, the final yarn can be economically constructed with over 50% by weight short cellulosic fibers 18.

Referring to FIG. 11, adjacent core-strands in the yarn 30 are spaced more than a core-strand diameter apart in the same manner described earlier with respect to the cross-laid webs of this invention. Accordingly, the yarns of this invention exhibit a spaced-junction type of structure. Applicant believes that this spaced-junction type of structure is responsible for the increase in bulk which is achieved when the number of individual filamentary elements 10 is increased to construct a yarn of a given denier.

YARN EXAMPLE

Two separate nylon yarns having 140 denier core-strands were constructed. The first was made by flocking a 140 denier-68 filament Nylon yarn. This yarn was flocked as a unit by applying adhesive to the surface thereof and passing the yarn through a chamber containing a suspension of short wood pulp fibers therein. The second yarn was made by flocking ten separate core-strands 12 individually, each core-strand 12 being a 14 denier-2 filament Nylon yarn. The ten flocked core-strands were then bonded together without twisting to form a Nylon yarn having a core-strand denier of 140. The second yarn which was constructed from 10 separate flocked filamentary elements 10 had considerably greater bulk than the Nylon yarn formed from a single 140 denier-68 filament core-strand.

KNITTED FABRIC EXAMPLE

Both of the 140 core-strand denier yarns made as described above were knitted on a Brother's flat bed knitted with no further treatment. The knitted fabric made from the single strand flocked yarn (140 denier-68 filament) had a basis weight of about 25 pounds per ream of 2,880 square feet, and a thickness of about 0.023 inches as measured on a Federal bulker with no weight added. This is equivalent to 32 grams/square inch pressure on the measureing foot of the Federal bulker.

In distinction to the above knitted fabric, the knitted fabric made from the 140 core-strand denier yarn including the 10 flocked filamentary elements 10 described above had a basis weight of about 76 pounds per ream of 2,880 square feet, and a thickness of 0.067 inches. This structure was extremely bulky, soft and aesthetically pleasing.

What is claimed is:

1. A flocked filamentary element suitable for use in the manufacture of textile substitutes such as webs, yarns, and the like, said filamentary element including:

A. a core-strand of at least one polymeric filament, said core-strand having a denier no greater than about 40;

B. an adhesive layer on said core-strand; and

C. substantially individualized cellulosic fibers adhered by said adhesive layer to said core-strand, said individualized cellulosic fibers being of a papermaking length less than about 6.35 millimeters and no less than about 1 millimeter, said cellulosic fibers constituting over 50% by weight of the filamentary element.

2. The flocked filamentary element according to claim 1, wherein said adhesive layer constitutes a weight percent add-on of from about 30 to about 300.

3. The flocked filamentary element according to claim 1, wherein the substantially individualized cellulosic fibers are wood pulp fibers.

4. The flocked filamentary element according to claim 3, wherein said core-strand denier is in the range of from about 7 to about 14, the denier of the individual filaments in the core-strand have a denier greater than 1.5, and the weight percent of wood pulp fibers is greater than 60%.

5. The flocked filamentary element according to claim 4, including at least 75% by weight wood pulp fibers.

6. A textile substitute including a plurality of flocked filamentary elements as described in claim 1, said flocked filamentary elements being adhered to each other by means of their respective adhesive layers.

7. The textile substitute according to claim 6, wherein the weight percent adhesive add-on of each filamentary element is from about 30 to about 300.

8. The textile substitute according to claim 7, wherein the core-strand denier of each filamentary element is in the range of from about 7 to about 14, the denier of the individual filaments in each core-strand is greater than 1.5, and the individualized cellulosic fibers are wood pulp fibers constituting over 60% by weight of each filamentary element.

9. The textile substitute according to claim 8, wherein at least 75% by weight of each filamentary element is wood pulp fibers.

10. The textile substitute according to claim 6, wherein said flocked filamentary elements cross each other in the form of a web, and are adhered to each other at their crossings by means of their respective adhesive layers.

11. The fibrous web according to claim 10, wherein said web is a non-woven fabric including at least two plies of said wood pulp flocked filamentary elements, the filamentary elements within each ply being aligned generally in the same direction, the direction of filamentary element alignment in one ply being disposed substantially 90 degrees to the direction of filamentary element alignment in an adjacent ply, whereby the filamentary elements in the adjacent plies cross each other and are adhered to each other by means of the adhesive layers associated with said filamentary elements.

12. The textile substitute according to claim 6, wherein said flocked filamentary elements are aligned in substantially the same general direction in the form of a yarn, and are adhered to each other by means of their respective adhesive layers.

13. The yarn according to claim 12, wherein the weight percent adhesive add-on of each filamentary element is from about 30 to about 300.

14. The yarn according to claim 13, wherein the core-strand denier of each filamentary element is in the range of from about 7 to about 14, the denier of the individual filaments in each core-strand is greater than 1.5, and the individualized cellulosic fibers are wood pulp fibers constituting over 60% by weight of each filamentary element.

15. The yarn according to claim 14, wherein at least 75% by weight of each filamentary element is wood pulp fibers.

16. A textile substitute including a plurality of flocked filamentary elements each filamentary element including a core-strand of at least one polymeric filament, said core-strand having a denier no greater than about 40, and substantially individualized cellulosic fibers adhered by an adhesive layer to said core-strand, said individualized cellulosic fibers being of a papermaking length of less than about 6.35 millimeters and no less than about 1 millimeter, said cellulosic fibers being present in a sufficient concentration such that over 50% of the crossings between the flocked filamentary elements comprise spaced junctions, said flocked filamentary elements being adhered to each other at the crossing by means of their respective adhesive layers.

17. The textile substitute according to claim 16, wherein said flocked filamentary elements cross each other in the form of a web.

18. The textile substitute according to claim 16, wherein said individualized cellulosic fibers constitute over 50% by weight of each of the filamentary elements.

* * * * *

PO-1050
(5/69)

UNITED STATES PATENT OFFICE
CERTIFICATE OF CORRECTION

Patent No. 3,968,283 Dated July 6, 1976

Inventor(s) Richard W. Schutte

It is certified that error appears in the above-identified patent and that said Letters Patent are hereby corrected as shown below:

Column 7, line 40, the formula should read
--((Wc+a-Wc)/Wc)x100

Column 1, line 14, add --)-- between "meters" and ",".
Column 7, line 31, add --,-- after "Trenton".
Column 7, line 36, change "present" to --percent--.
Column 10, line 66, add --described-- between "be" and "applicant".
Column 13, line 15, delete first "s" after "filaments(s)"
Column 15, line 58, "knitted" should be --knitter--.
Column 18, line 12, "crossing" should be --crossings--.

Signed and Sealed this
Sixteenth Day of November 1976

[SEAL]

*Attest:*

RUTH C. MASON
*Attesting Officer*

C. MARSHALL DANN
*Commissioner of Patents and Trademarks*